US006176244B1

(12) United States Patent
Schouten

(10) Patent No.: US 6,176,244 B1
(45) Date of Patent: Jan. 23, 2001

(54) MACHINE DISH-WASHING PROCESS

(75) Inventor: Cornelis Schouten, Rotterdam (NL)

(73) Assignee: Epenhuysen Chemie N.V., Zwijndrecht (NL)

( * ) Notice: Under 35 U.S.C. 154(b), the term of this patent shall be extended for 0 days.

(21) Appl. No.: 09/127,034

(22) Filed: Jul. 31, 1998

(30) Foreign Application Priority Data

Jul. 31, 1997 (NL) ..... 1006700

(51) Int. Cl.[7] ..... B08B 1/02; B08B 3/00; B08B 3/08; B08B 3/10; B08B 9/20

(52) U.S. Cl. ..... 134/25.2; 134/26; 134/29; 134/30; 134/32

(58) Field of Search ..... 134/32, 25.2, 30, 134/26, 29

(56) References Cited

U.S. PATENT DOCUMENTS 3,816,318 * 6/1974 Hentschel ..... 252/89
5,772,785 * 6/1998 Schouten ..... 134/25.2
5,888,954 * 3/1999 Haerer et al. ..... 510/226
5,972,875 * 10/1999 Crutcher et al. ..... 510/421

FOREIGN PATENT DOCUMENTS 0 282 214 9/1988 (EP) .
0 406 682 1/1991 (EP) .
0 465 454 1/1992 (EP) .
0 712 599 5/1996 (EP) .

* cited by examiner

*Primary Examiner*—Zeinab El-Arini
(74) *Attorney, Agent, or Firm*—Young & Thompson

(57) ABSTRACT

A machine dish washing process wherein a detergent is given such a composition and/or is dispersed over the crockery in such a way that with the detergent a cleaning layer with an appearance distinct from water is formed on preferably at least substantially the complete surface of the crockery, which distinction preferably can be discerned by the naked eye.

24 Claims, No Drawings

MACHINE DISH-WASHING PROCESS

FIELD OF THE INVENTION

The invention relates to a machine dish-washing process and more particular to an improvement in continuous or discontinuous machine dish-washing, whether conducted using a single tank or multi tank or conveyor type dish washer. The invention is also concerned with a detergent to be used with said machine dish washing process, use of a detergent known as such in said dish washing process, and a dish washing machine that is adapted to carry out said process.

BACKGROUND OF THE INVENTION

Typical dish washing machines, e.g. of the conveyor type, wash the crockery with large amounts of water containing a small amount of detergent. The detergent is directly injected into the water tank below the wash section until a concentration of approximately 0.2 wt % active cleaning agents in the solution is obtained, and water with the detergent is continuously drawn from said tank and poored over the crockery, and is then collected again in said tank. Very heavily soiled crockery is prior to the above described machine treatement subjected to a labor intensive cleaning, so called "stripping", wherein the crockery is soaked in water with a relatively high concentration of active cleaning agents for several hours. EP-A-0465454 discloses a machine dish-washing process wherein a minimum amount of concentrated fluid detergent is undiluted mistly like sprayed over the crockery to cover the complete surface of the crockery with the concentrate. EP-A-406628 discloses a machine dish-washing process wherein in a separate circulation a highly concentrated fluid detergent is poured out over the crockery in excess and collected in a separate tank and is drawn therefrom for repeated use. The object of both the above disclosures is to provide maximum cleaning effect with minimum detergent consumption and minimum use of labour and machines by improving the chemical action, such that the environment is saved as good as possible against costs as low as possible. This is also an alternative object of the present invention.

SUMMARY OF THE INVENTION

In one aspect the object of the invention is also an application rate wherein the preferably highly concentrated detergent, compared to the water dispersion in a wash zone of a typical conveyor type dish washing machine of 1000 1/hr, is applied at extremely low volume of preferably 100 1/hr at the most, more preferably 25 1/hr at the most, most preferably 10 1/hr at the most, wherein said application volumes relate to the foamless mode of the detergent, e.g. as it is present in the storage container.

Due to the aggressive action of the detergent, dispersing thereof must take place in a shielded chamber, such that the application means can not be checked properly for proper functioning. If e.g. a nozzle for dispersing detergent over the crockery is clogged, a part of the crockery at least will insufficiently contact the detergent such that its cleaning is not optimum. This drawback will be most clearly noticed with systems wherein minimum amounts of detergent are directly dispersed on the crockery.

It is an object of this invention to obtain better controllable dispersing of detergent over the crockery, e.g. to check the application means for proper functioning. This object is met by dispersing the detergent over the crockery or give it a composition such that at least on the crockery, preferably on sloping parts thereof, a clear visual distinction with rinsing water is obtained. Although at this moment it is expected that generation of a foam layer of detergent on the crockery offers the clearest visual detection means, different alternatives seem usable, such as the generation of a gel- or paste layer of the detergent on the crockery. That is why it is expected that as the visual detection means according to the invention each embodiment is applicable wherein a relatively thick layer of detergent is created on the crockery. The layer thickness is preferably such that a clear distinction is made with water or a detergent behaving like water, since that can merely make a thin film on the surface of the crockery. The needed visual detection function can also be obtained by providing a treacly behaviour of the detergent on the crockery, such that it flows from the crockery much slower than e.g. water or typical water with some dissolved detergent. Foam, gel or paste like detergent offer e.g. such treacly behaviour and have therefore e.g. the possibility to make a relatively large layer thickness on the crockery, wherein said layer thickness is preferably substantially larger than the thickness of a water film adhering to a sloping surface of the crockery.

In here, "Sloping part of the crockery" means a part where as a rule water will not remain, like e.g. the top of a dish standing on its side.

DETAILED DESCRIPTION OF THE INVENTION

The invention offers the greatest advantages with machine dish washing processes wherein detergent is directly, e.g. from the storage container, dispersed over the crockery without recirculation and in mimimum amounts to cover the surface of the crockery as completely as possible with minimum losses. Apart form that, formation of foam, gel or paste of the detergent on the crockery offers further advantages, such as enhanced adhesion to the crockery such that too soon dripping or flowing from the crockery, leading to losses, is as good as possible limited; possibility for "bombardment" effect by proper choice of the granule or droplet size, such that with minimum amounts, e.g. just enough to completely cover the crockery, a mechanical next to chemical cleaning can be obtained; predictable dispersal during application due to e.g. absence of splashing or air-floating, such that e.g. by unintended opening of the applicator section dispersing of the detergent is limited or even absent, such that the safety means can be relatively limited of design; higher concentrations on the crockery can be provided resulting in e.g. small volumes to be applied each dish washing having positive influences on shipment and storage; improved cleaning action and thus therewith e.g. a further decrease of consumption; protective action for the active cleaning agents contacting the crockery, e.g. against mechanical action of fluid jets, such that they can do their cleaning job as undisturbed as possible for e.g. a period as long as possible. Compared to dispersing a concentrated detergent in the shape of droplets that form a liquid layer that almost instantaneously flows from the crockery, the dispersing rate of foam, gel or paste can be substantially lower because of e.g. slower flowing from the crockery if a prolonged contact time is demanded before it is rinsed off from the crockery. Furthermore, foam formation on the crocker provides the further advantage of being clearly visible, simple applicator means that can be e.g. cheap, little sensible for malfunctioning and of longlivety, and the possibility after settlement on the crockery to effectively disperse thereover, e.g. by virtue of the bubble effect, such that the requirements, e.g. with respect to dispersing, for the applicator means are less high. For optimum wetting of the crockery with detergent at low doses, foam allows application of applicator nozzles with comparatively large applicator channels e.g. resulting in less chances for clogging of the nozzles or less high operating pressures. Apart from the fact that foam offers the possibility for extremely economical application at low levels of investment for the applicator means. E.g. the application volume to be provided with foam is many times, e.g. 100 times, larger than if the same amount of concentrated detergent is sprayed as a gentle mist. With a concentration of the e.g. alkalinic agents of more than 10 wt % a typical dose for the concentrated detergent ranges e.g. between 1 and 5 1/hr for a typical conveyor type dish washer with a typical conveyor speed. With foam, a flow effect over the crockery can also be generated, e.g. if foam cells of the boundary layer next to the crockery successively break. Paste and gel offer further the advantages that they can e.g. be dispersed in very tiny droplets such that they disperse very uniformly while due to the nature of gel or paste, said droplets can e.g. generate a "bombardment" effect.

In one aspect the invention is based on the recognition that the detergent, if present on the crockery, is clearly visually distinct from rinsing water present on the crockery. The operating staff of the dish washer can then at a safe distance from the applicator means, or with the.applicator means inactivated, detect if the detergent is applied on the crockery as required. E.g. with a conveyor type dish washer, if one doubts whether the detergent is correctly dispersed, one can pass some crockery on the conveyor along the applicator section, while the rinsing sections are shut off, and subsequently visually examine the crockery in a down stream section to see if the detergent is present.

The detergent, preferably together with at least part of the soil, is subsequently removed from the crockery, preferably by vigourously flushing comparable to the washing action in a conventional machine dish washer, e.g. by continuously drawing water, possibly with dissolved detergent, in a rate of about 1000 1/hr from a downstream tank, pouring it over the crockery and recollecting it in said tank for renewed use.

The machine dish washer according to the invention is characterized by the modification to carry out the process, such as e.g. the presence of convenient applicator means for e.g. foam formation or dispersing of a gel or paste type detergent and/or e.g. modification to the control system of the machine. With an exsisisting conveyor dish washer, e.g. a Hobarth series FT-E, e.g. model 2-B-3, one or more spraying arms of e.g. a prewash or wash section can be inactivated, to offer room for the applicator means to carry out the process according to the invention. The detergent according to the invention on characterized by its applicatability for use in the process, such as e.g. its usefulness to generate foam, or the appearance as a gel or paste. The detergent can be made from fluid and/or powdery materials. Preferably the detergent is dispersed over the crockery with a concentration of at least about 0.5 wt %, more preferably at least about 5 wt %, more preferably at least about 10 wt %, more preferably at least about 15 wt %, most preferably 20 wt % of one or more of the active cleaning agents.

If extra chemical action is required, it is prefered to have a contact time before the detergent together with the soil are removed from the crockery. The contact time preferably lasts at least one, preferably several seconds, more preferably between 5 and 15 seconds. It can be advantageous, e.g. from the viewpoint of optimum chemical action, not to deliberately disperse further detergent or other fluid over the crockery. It can also be advantageous, to provide the detergent on the crockery with as little force as possible, e.g. like a gentle mist.

For an optimum result, the detergent is preferably dispersed such that it completely covers the crockery. Dispersing preferably takes place at low volume and intensity compared to pouring diluted aqueous detergent over the crockery in large jets, as is more typical. The dispersing can be from one single nozzle, but to properly cover the crockery from all sides it is preferred, to apply with a respective nozzle from at least two preferably opposite sides of the crockery. It is expected that with at least two nozzles on each side the dispersing will be most uniform. If e.g. a suspension cloud of detergent is generated, it should however be possible to do with one single nozzle, wherein possible use is made of a convenient, e.g. swirling flow of the cloud, to reach all surfaces of the crockery. Preferably the nozzle aims at the crockery. Preferably the detergent has a temperature substantially lower than the temperature prevailing in the dish washing machine during dispersing, e.g. a temperature at least about similar to room temperature.

The machine dish washing process can have one or more optional pre wash cycles or zones, one or more wash cycles or zones, one or more rinse cycles or zones and one or more dry cycles or zones, wherein according to the invention the dispersing of the detergent takes place prior to the final rinse cycle or zone, preferably prior to the first wash cycle or zone.

The action (e.g. the concentration of the active cleaning agents) of the detergent, dispersed according to the invention and the duration of the contact time (with e.g. a so called conveyor type dish washer provided by the speed of the crockery through the machine and the distance of the applicator section according to the invention to the subsequent rinse or wash section) are preferably mutually adapted such that the soil on the crockery (in particular grease, fats, starch, stains (e.g. from tea) and protein) are sufficient and preferably completely removed, or that in the sense as meant here at least a proper preparation of the crockery is obtained such that the required cleaning result is provided by the subsequent one or more wash cycles or zones. Preferably most of the bacteria and preferably all bacteria are destroyed. The crockery is e.g. rinsed with water containing the detergent washed from the crockery and provided thereon in the earlier cycle or zone, and possibly seperately added agents.

By way of example the machine for carrying out the process may have a conveyor (e.g. a conveyor belt or chain) to successively pass the crockery, preferably positioned in convenient so called trays, across several sections provided in a common elongated, tunnel-like housing and wherein the conveyor extends beyond the front and back of said housing such that the crockery can be fed in and out there, respectively. As such the crockery is successively passed through a pre wash section, an applicator section according to the invention, a wash section, a rinse section, a post rinse section and a dry section. Water is fed to the post rinse section and flows in counter current with respect to the flow of crockery cascade-fashion through the respective tanks of the different sections, and is disposed at the pre wash section. Brightener is dispersed in the post rinse section. Apart from the applicator section, water is pumped from the relevant tank and poured over the crockery and recollected in the tank. The temperature is e.g. 30° C., 50° C. and 70° C. in the pre wash section, wash section and rinse section, respectively. It will be appreciated that according to this embodiment, the crockery is pre wetted before it arrives in the applicator section where the cleaning layer according to the invention is applied. However application of the invention without pre wetting is feasible as well. An illustrative dish washing machine to embody this invention can be based on the one that is disclosed in applicant's earlier EP-A-0712599, in particular FIG. 1 and the corresponding specification, for which reason EP-A-0712599 is contained in here by reference. For embodying this invention, compared to EP-A-0712599, the section 5 is modified to contain applicator means to carry out the process according to the invention.

While all of the cleaning agents required may be applied over the crockery with dispersing the detergent according to the invention, it may be advantageous that some agents are introduced in a different, perhaps more conventional, manner, e.g. if two or more agents are more or less incompatible if concurrently introduced as a mixture.

The detergent can have each proper format during application, like e.g. liquid, powder, solution, emulsion, gel, paste. Any detergent known to the expert for cleaning crockery can be used, generally if it contains an alkalinic active and/or a sequesteric active component. One or more convenient agents can be added to this substance if required for providing the effect according to the invention. This can e.g. be a convenient colouring agent, or a gelling or foaming or bleaching or dispersing agent or an inhibitor. The dissolving agent can be water, but any convenient non-aqueous dissolving agent as well.

For purposes of further illustration, the invention is further in a non-limiting way described referring to generating a foam layer on the crockery. The foam can be provided by dispersing foam flakes from one or more conveniently located and directed nozzles such that they settle on the crockery, possibly while using an appliance, such as a blower. As an alternative to flakes moving seperately through the air, it is e.g. feasible as well that a foam blanket or foam jet is generated that more or less uninterrupted bridges the distance between the nozzle (nozzles) and the crockery. Alternatively it is feasible that droplets of detergent are dispersed that generate foam either while bridging the distance between the nozzle and the crockery or when settling on the crockery. Such droplets can be e.g. composed of gel or paste. They can also be composed of powder. Combinations of such flakes, blankets, jets and droplets are also feasible. The foam can behave like whirling flakes and more or less smooth on the surface of the crockery, but can also more or less clatter on the crockery like rain. This field contains many examples illustrating that foam generation in a machine dish washing process should be avoided, such that this field lacks any hint that foam formation can be advantageous. Intentionally applying foam generation according to the invention therefor should be observed as overcoming a prejudice in the field. Based on the teachings of the prior art it is surprising that advantageous effects can be obtained.

Generation of foam preferably takes place such that the foam layer provided on the crockery is thick enough to be visually detected from some distance. The foam layer e.g. has a thickness of at least about 0.5 mm., more preferably at least about 1.0 mm, most preferably at least about 1.5 mm. Furthermore the foam is preferably "airy" enough and therefore contains preferably at least about 90 vol % air, more preferably at least about 95 vol % air, most preferably about 99 vol % air. In stead of air, the foam can contain a different gas like nitrogen. The generated foam can have a stable or unstable nature. It is preferable that the rate of instability and the thickness of the foam layer generated on the crockery are mutually adapted such that after at least some seconds, preferably at least 2 seconds and more preferably after expiry of the contact time the foam layer is still at least partially present, such that the detergent is preferably at least partially like foam if removed with the soil from the crockery. It is preferable that the foam layer still has at least about 75% of its initial thickness after 2 seconds contact time on the crockery, and it is also preferable that the foam layer still has at least about 25% of its initial thickness with (after) elapse of the contact time. The rate of instability of the foam can be predicted by test systems known to the expert. In this connection reference is made to DIN 53902, in particular page 1 or page 2 (Schlagschaum and Ross-Miles-Test, respectively), inserted here by reference. At present, a moderate foaming detergent is preferred. However it is not excluded that the invention also applies with a low foaming or high foaming detergent.

Foaming can be obtained by adding a foaming system to the detergent. This foaming system can be mixed with the detergent in advance, or can e.g. be mixed at the moment of application. If the detergent has e.g. enough foaming action by nature, one could also rely on proper application, e.g. by using a properly designed nozzle. If it is e.g. meant to re-use the detergent in almost the same concentration after being dispersed over the crockery, like e.g. known as such from EP-A 0406682, the foaming system is obtained automatically because the detergent accepts fats from the crockery, such that deliberately adding a foaming agent is then not necessary. The foam can be generated by vigorously mixing detergent with a gas or gas mixture like air, e.g. by using a proper stirring means or using gas jets directed in the detergent, or alternatively by using a bubble effect, e.g. from a gas generating compound or any other means known as such to the expert. The machine dish washer may have appropriate means to carry out such mixing, like stirring means or gas jetting means.

Preferably a foaming system is selected wherein after washing from the crockery, foaming is suppressed or even prevented, e.g. to substantially accelerate defoaming or foam degradation, e.g. by using different temperature ranges. This option is particularly selected when the foaming action is such that without counter actions there will be a foam formation in a relevant zone of the dish washer by the detergent washed from the crockery, such that the proper functioning of the dish washer is at least interfered or at least substantially made impossible. A foam system is e.g. selected that provides foam at low temperature, but provides at least substantial less foam at high temperature, e.g. above 40° C. An example for this are specific surfactants known to the expert, such as applied as brightener in machine dishwasing processes, wherein the concentration and composition are selected such that a so called cloud point is obtained that is at maximum equal to and is preferably lower than the temperature of e.g. the water in the wash section. Typically the cloud point and so the temperature above which the foam generating property substantially decreases will fall with rising concentration of said substances. "Cloud point" is the temperature at which the detergent in the concentration of application yields cloudiness in the water, such that there is at least substantially no foam generation any more at and above said temperature. Alternatively a foaming system is selected wherein after being washed from the crockery the foam is contacted by a foam inhibitor, e.g. based on silicon or based on nonionic surfactants. This alternative can also be used in combination with the first mentioned system.

A highly concentrated detergent having foaming properties, e.g. having an added foaming agent and applicable in a machine dish washing process is novel in this field, in particular if it has a pH higher than 8 or lower than 6, particularly higher than at least about 12, more preferably higher than at least about 13, most preferably higher than at least about 13.3, e.g. about 13.9. The detergent can contain the here or elswhere in this disclosure indicated substances in each composition of choice. Such detergent then can contain at least about 5 wt %, preferably at least about 10 wt %, more preferably at least about 15 wt % NaOH and/or KOH. The foaming agent can contain surfactants, e.g. be a mixture of nonionic and anionic surfactants, to which e.g. a substance known as such is added to stimulate dissolving of the surfactants at high pH levels. The detergent can contain at least about 1 wt % of the surfactants. A convenient mixture of nonionic and anionic surfactants is such that with rising temperature the foaming action decreases. In that connection it is preferable that the foaming action has at least almost disappeared from a temperature of at least about 60° C., more preferably at least about 50° C., most preferably at least about 40° C. In this connection it should be appreciated that after it has flown over the crockery the detergent is extremely diluted in the water tank of the wash or rinse zone and that the concentration of the surfactants in the detergent must be high enough to inhibit foaming action in the water tank starting from a threshold temperature. Indeed, typical machine dish washing processes sometimes show foaming which is considered as a disadvantageous side effect, however this is concerned with a foam layer floating on the fluid in the tank which foam is not generated on the crockery. The foam layer is generated by soap formation due to reaction of the alkalinic substances with the fats from the crockery, and the strong water movements at the surface of the tank by virtue of the large amounts of wash water coming into the tank from above.

By way of example a convenient composition of detergent with foaming system for carrying out the process contains NaOH or KOH; a water conditioning agent like NTA, EDTA, phosphates, zeolites or phosphonates; sequestering agents; possibly further agents like a bleaching agent; surfactants; and balance water, wherein the concentration of surfactants is selected such that enough foam is generated while the cloud point is equal to or lower than the temperature of the wash water, and wherein the concentration of NaOH or KOH is selected as high as possible (e.g. between about 20 and about 30 wt %) concerning the other substances, in particular the concentration of surfactants. Based on his general knowledge the expert will be able to select the proper concentrations for the several substances of the detergent. The detergent can be dispersed over the crockery undiluted or diluted, e.g. by admixing water into the line extending from the detergent storage container to the applicator means in the dish wahsing machine.

The detergent e.g. contains between about 1 wt % and about 5 wt %, preferably about 2 wt % amphoteric, between about 5 wt % and about 10 wt %, preferably about 7 wt % nonionics and between about 5 wt % and about 15 wt %, preferably about 10 wt % hydrotroops. The hydrotroops are agents which help keep the nonionics dissolved in an environment with a high concentration of ions, the amphoterics are agents which facilitate foaming of the nonionics. The nonionics begin to defoam at elevated temperatures. If the concentration of nonionics is higher than the concentration of amphoterics, the defoaming action of the nonionics will counteract the foaming action of the amphoterics, such that the complete foaming action is degraded. An example of a hydrotroop is the sodium salt of xylene sulfonate. An example of nonionics is alkylpolyethyleneglycolether(s) with 9 mol EO. An example of amphoteric is alkylamidbetaine. The applied amphoteric is preferably based on betaine or imidazoline. A convenient alternative for amphoteric is amine oxide.

The invention is also concerned with a machine dish washer, in particular of the conveyor type, in particular that is adapted to carry out. the process according to the invention, and in particular therefore comprises application means such as one or more applicator nozzles and/or a foam, gel or paste generating appliance to disperse a foam, gel or paste like detergent over the crockery.

What is claimed is:

1. A dish-washing process in a dish-washing machine in which crockery is washed with a dish washing composition, comprising the steps of:

placing crockery to be washed into the dish-washing machine;

dispersing into the dish-washing machine a dish washing composition in foam form;

allowing the composition to settle onto the crockery within the dish-washing machine;

washing the crockery with the dish washing composition; and removing the crockery from the dish-washing machine.

2. The process of claim 1, wherein the composition is defoamed after the dish washing composition in foam form is dispersed over the crockery.

3. The process of claim 1, wherein a nonionic agent is added to the dish washing composition such that the composition does not at least substantially foam in a first temperature range above a threshold temperature ranging between 30° C. and 60° C. compared to a different second temperature range below the threshold temperature and wherein the composition is at a temperature below the threshold temperature during dispersing over the crockery within the dish-washing machine, and after dispersing is brought to a temperature above the threshold temperature within the dish-washing machine to defoam the composition.

4. The process of claim 3, wherein the threshold temperature is 40° C.

5. The process of claim 3, wherein the nonionic agent is alkylpolyethyleneglycolether.

6. A dish-washing process in a dish-washing machine, comprising the steps of:

placing crockery to be washed into a wash space of the dish-washing machine;

providing a liquid dish washing composition and processing it such that it foams;

dispersing the dish washing composition in foam form through at least one nozzle into the wash space of the dish-washing machine containing the crockery to be washed so that the composition is directed towards and contacts the crockery in the wash space;

allowing the composition to settle onto the crockery so that the crockery in the washing space is at least partially covered with the composition;

removing the composition from the crockery by pouring washing water over the crockery;

rinsing the crockery;

removing the washed and rinsed crockery from the machine.

7. The process of claim 6, wherein after dispersing, the composition is subjected to a defoaming process to defoam it.

8. The process of claim 6, wherein the composition has a foaming nature at a first temperature which nature is absent at a second temperature, higher than the first temperature, and wherein the composition is at the first temperature during dispersing and after dispersing is brought to the second temperature within the dish-washing machine so that the composition is defoamed.

9. The process of claim 8, wherein the first temperature is below 40° C. and the second temperature is above 40° C.

10. The process of claim 8, wherein the composition is brought to the second temperature while on the crockery.

11. The process of claim 6, wherein the dish washing composition in foam form is dispersed into foam flakes.

12. The process of claim 6, wherein the dish washing composition is processed by mixing with a gas to obtain the foam form.

13. The process of claim 6, wherein said composition settles on the crockery so that the crockery is at least partly covered with a foam layer having a thickness of at least about 0.5 mm.

14. The process of claim 6, wherein said composition settles on the crockery so that the crockery is at least partly covered with a foam layer which covers the crockery during a contact time having a beginning and an end, after which the composition is removed from the crockery, and wherein at the beginning of the contact time the foam layer has a first thickness and at the end of the contact time the foam layer has a second thickness that is at least about 25% of the first thickness.

15. The process of claim 6, wherein the dish washing composition in foam form contains at least 90% air by volume.

16. The process of claim 6, wherein the dish washing composition in foam form has a pH of at least 12.

17. The process of claim 16, wherein the dish washing composition in foam form has a pH of at least 13.

18. The process of claim 6, wherein the dish washing composition in foam form contains at least 5% by weight NaOH.

19. The process of claim 6, wherein the dish washing composition in foam form contains at least 5% by weight KOH.

20. The process of claim 6, wherein the dish washing composition in foam form contains a mixture of nonionic and anionic surfactants.

21. The process of claim 6, wherein the dish washing composition in foam form contains a mixture of nonionic and anionic surfactants in an amount of at least 1% by weight.

22. The process of claim 6, wherein the dish washing composition is dispersed from a plurality of nozzles which are directed onto the crockery.

23. The process of claim 6, wherein the dish-washing composition is stored in a storage container and is taken therefrom to be dispersed over the crockery within the washing section of the dish-washing machine.

24. The process of claim 6, wherein the crockery to be washed is wetted prior to being at least partly covered with the composition.

* * * * *